US005890827A

United States Patent [19]

Kageyama et al.

[11] Patent Number: 5,890,827

[45] **Date of Patent: *Apr. 6, 1999**

[54] BAR EXTRUDING IMPLEMENT WITH EJECTOR

[75] Inventors: Hidehei Kageyama; Shouji Anzai; Yoshihide Mitsuya, all of Kawagoe, Japan

[73] Assignee: Kotobuki & Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 553,779

[22] Filed: Oct. 23, 1995

[51] Int. Cl.[6] ..... B43K 21/20

[52] U.S. Cl. ..... 401/63; 401/64

[58] Field of Search ..... 401/63, 64

[56] References Cited

U.S. PATENT DOCUMENTS

| | | | |
|---|---|---|---|
| 296,654 | 4/1884 | Wales | 401/64 |
| 1,956,271 | 4/1934 | Chesler | 401/64 |
| 1,995,757 | 3/1935 | Stehl | 401/64 |
| 2,110,551 | 3/1938 | Friedlein et al. | 401/63 |
| 2,164,166 | 6/1939 | Schaefer | 401/64 |
| 2,557,320 | 6/1951 | Smith, Jr. | 401/63 |
| 2,564,727 | 8/1951 | Sams | 401/63 |
| 2,595,001 | 4/1952 | Sams et al. | 401/63 X |
| 2,598,083 | 5/1952 | Tapner | 401/64 |
| 2,722,913 | 11/1955 | Aversa | 401/64 |
| 3,139,066 | 6/1964 | Aversa | 401/64 |
| 4,354,767 | 10/1982 | Tessier | 401/63 |

FOREIGN PATENT DOCUMENTS

| | | | |
|---|---|---|---|
| 245140 | 9/1926 | United Kingdom | 401/64 |
| 602984 | 6/1948 | United Kingdom | 401/64 |

*Primary Examiner*—Steven A. Bratlie
*Attorney, Agent, or Firm*—Rothwell, Figg, Ernst & Kurz

[57] ABSTRACT

A bar extruding implement extrudes a bar, such as a lead, a lipstick or the like, gradually and is capable of automatically ejecting a marginal portion of the bar. A projection formed on a sliding member inserted in an inner tube slides along a helical groove formed in the inner circumference of a barrel to advance the sliding member when a rotational operating head is turned to turn the inner tube in one direction, whereby a bar holder holding a bar is advanced gradually toward the front end of the barrel to extrude the bar from the front end of the barrel. Upon the arrival of the bar holder at a disengaging position, the sliding member is disengaged from the bar holder and advances forward through the bar holder when the inner tube is turned further after the bar holder has arrived at the disengaging position to eject a marginal portion of the bar remaining on the bar holder.

8 Claims, 18 Drawing Sheets

BAR EXTRUDING IMPLEMENT WITH EJECTOR

BACKGROUND OF THE INVENTION

1. Field of the Invention

The present invention relates to a bar extruding implement for extruding, when needed, a bar that wears down gradually, such as a black or color lead for a mechanical pencil, a crayon, an erasing rubber, a lipstick or a stick for an eyebrow pencil, capable of automatically ejecting a marginal portion of the bar, i.e., a loss portion unavoidably left unused in the bar extruding implement.

2. Description of the Related Art

Referring to FIG. 1 showing a previously proposed color lead extruding implement, i.e., a bar extruding implement, for extruding a colored lead of, for example, a colored pencil, the color lead extruding implement comprises a barrel 1, a rotational operating head 2 rotatably fitted in the rear end of the barrel 1, a helically wound wire 3 having a base end fixedly wound around the inner end of the rotational operating head 2 and inserted in the barrel 1, a color lead holding member 4 holding a color lead at its rear end, and inserted in and interlocked with the helically wound wire 3, and a barrel cap 5 screwed in the front end of the barrel 1 provided with an internal screw thread 1*a*. The rotational operating head 2 is provided with an annular protrusion 2*a* fitted in an annular groove 1*c* formed in the inner surface of the barrel 1 to restrain the rotational operating head 2 from falling off the barrel 1. The color lead holding member 4 has a projection 4*a* in engagement with a longitudinal guide groove 1*b* formed in the inner surface of the barrel 1 to restrain the color lead holding member 4 from turning, and three protrusions 4*b* extending between the coils of the helically wound wire 3. When the rotational operating head 2 is turned in one direction, the color lead holding member 4 is moved axially toward the front end of the barrel 1 by the helically wound wire 3, so that the color lead is extruded gradually from the tip of the barrel cap 5 attached to the front end of the barrel 1 as the rotational operating head 2 is turned. When the rotational operating head 2 is turned in the opposite direction, the color lead is retracted into the barrel.

The barrel 1 must be provided with the internal screw thread 1*a* in its front end, the longitudinal guide groove 1*b* for guiding the color lead holding member 4, and the annular groove 1*c* for receiving the annular protrusion 2*a* of the rotational operating head 2. Consequently, the color lead extruding implement has a complex construction and requires much assembling time. Since the coils of the helically wound wire 3 are liable to be formed at irregular pitches, the color lead cannot be smoothly extruded. Furthermore, when the color lead is worn out and only the marginal portion of the color lead is left on the color lead holding member 4, it is difficult to remove the marginal portion of the color lead from the color lead extruding implement in replacing the marginal portion of the color lead with a new color lead.

SUMMARY OF THE INVENTION

Accordingly, it is an object of the present invention to provide a bar extruding implement having a simple construction, and capable of being very easily assembled, of smoothly extruding a bar and of easily ejecting a marginal portion of the bar.

In one aspect of the present invention, a bar extruding implement comprises: a barrel having opposite open ends and internally provided with a helical guide means; an inner tube rotatably inserted in the barrel and provided with a longitudinal guide slit having a guiding part in its front end, a barrel cap connected to the front end of the inner tube, a rotational operating head joined to the rear end of the inner tube, a hollow bar holder fitted in the inner tube and provided with a projection on its outer surface so as to be in engagement with the longitudinal guide slit of the inner tube; a sliding member provided with a projection in engagement with the helical groove of the barrel; an interlocking means for interlocking the sliding member with the hollow bar holder; and a disengaging means for disengaging the sliding member from the bar holder at a disengaging position.

When the rotational operating head is turned in one direction to turn the inner tube, the projection of the sliding rod moves along the helical guide groove formed in the inner surface of the barrel. Consequently, the sliding member and the bar holder interlocked with the sliding member slide axially in the inner tube toward the front to extrude the bar held by the bar holder gradually. Upon the arrival of the bar holder at the disengaging position, the sliding member is disengaged from the bar holder, and the sliding member advances further through the bar holder and pushes the marginal portion of the bar out from the bar holder to eject the marginal portion of the bar from the bar extruding implement.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

First Embodiment

Figure 1:
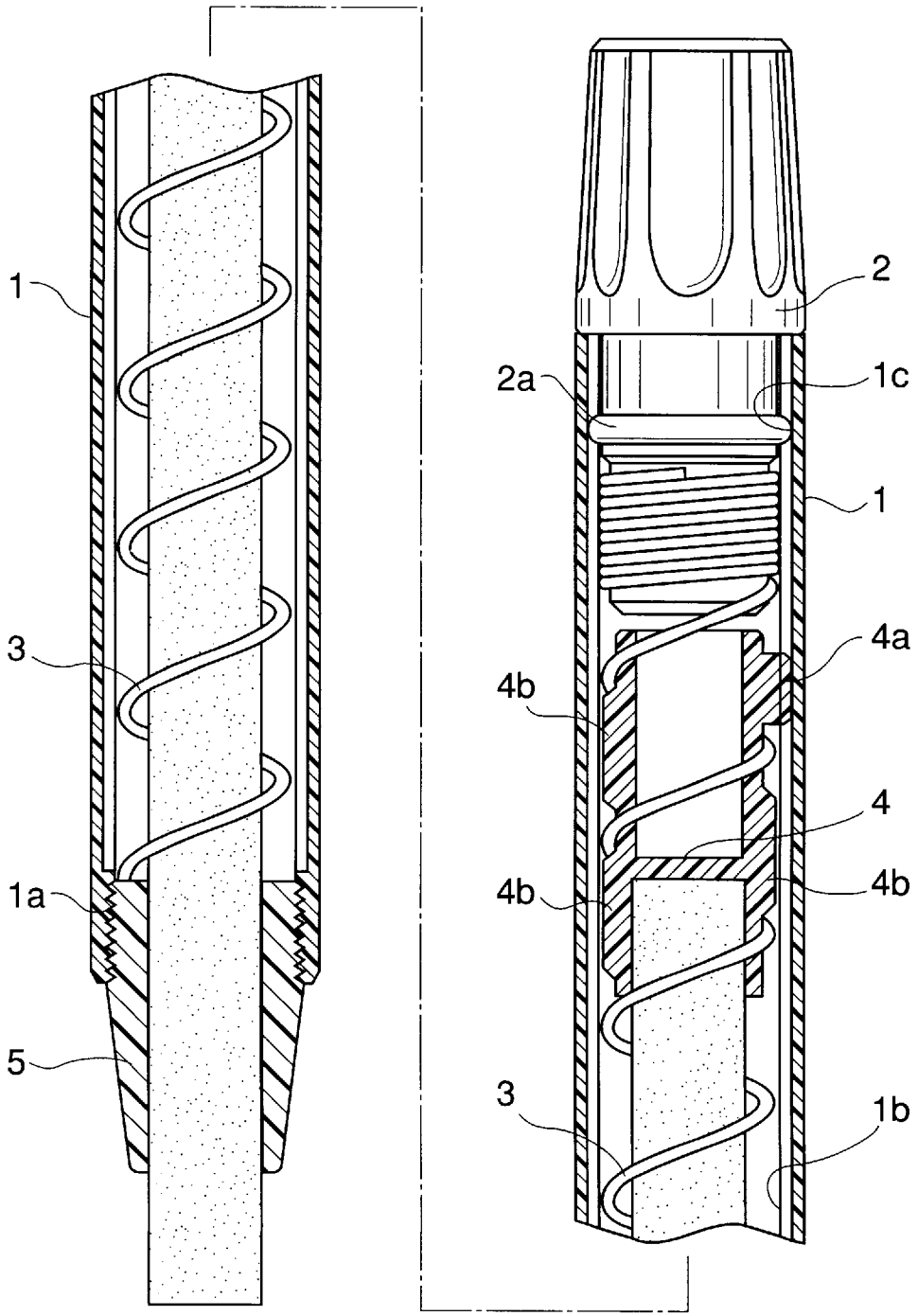
FIG.1 PRIOR ART
FIG. 1 is a longitudinal sectional view, with the middle portion omitted, of a conventional color lead extruding implement.
Figure 2:
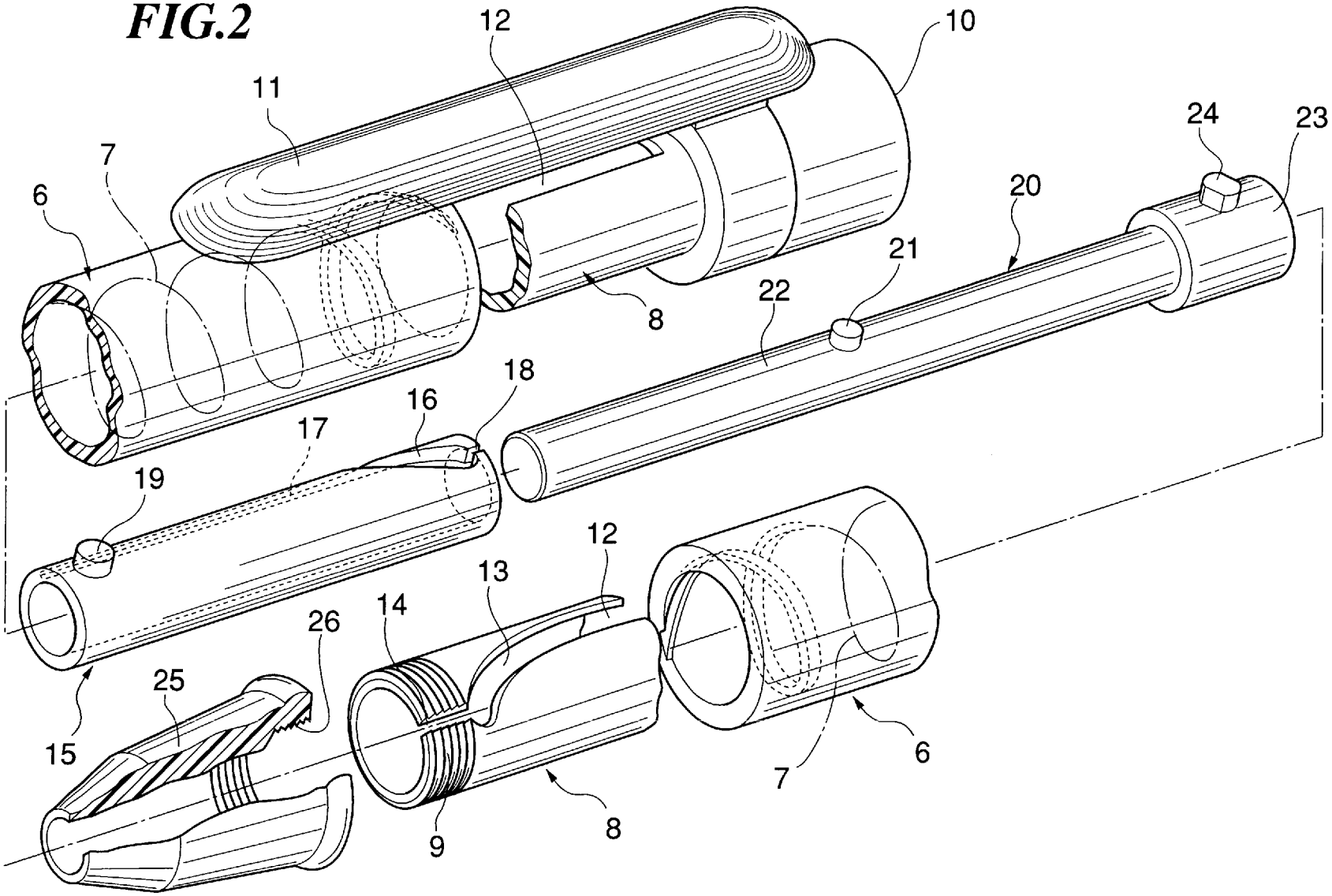
FIG. 2 is an exploded perspective view of a bar extruding implement in a first embodiment according to the present invention with certain portions omitted.
Figure 3:
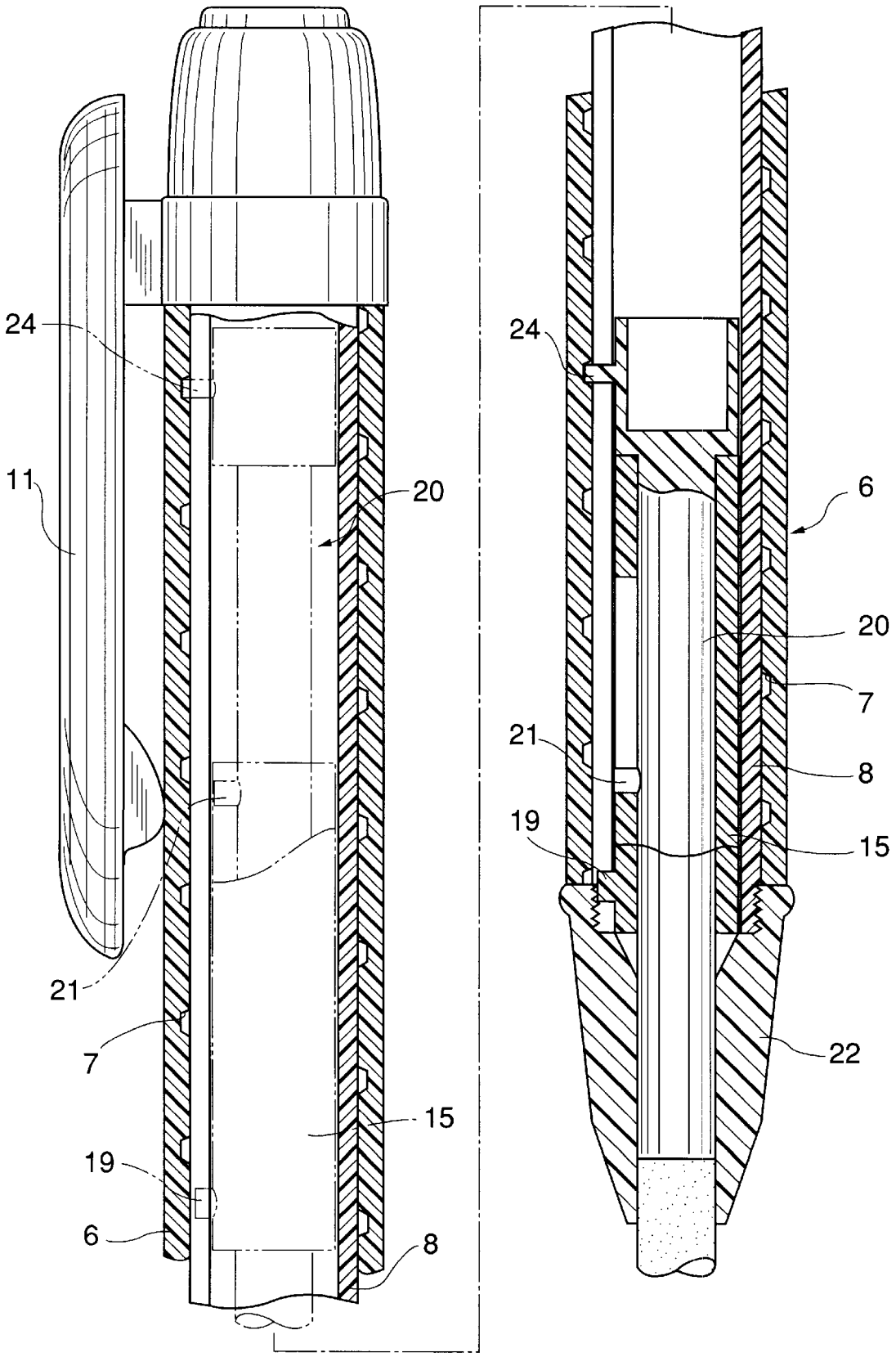
FIG. 3 is a longitudinal sectional view of the bar extruding implement of FIG. 2 with the middle portion omitted, a bar holder at its front limit position and a sliding rod at its rear limit position.
Figure 4A:
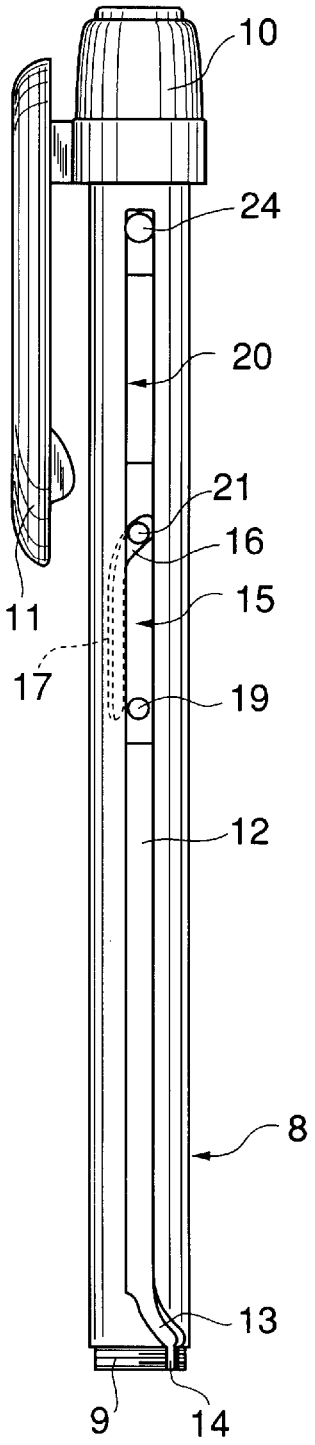
FIGS. 4A , 4B and 4C are fragmentary front views of assistance in explaining the operation of the bar extruding implement of FIG. 1.
Figure 4B:
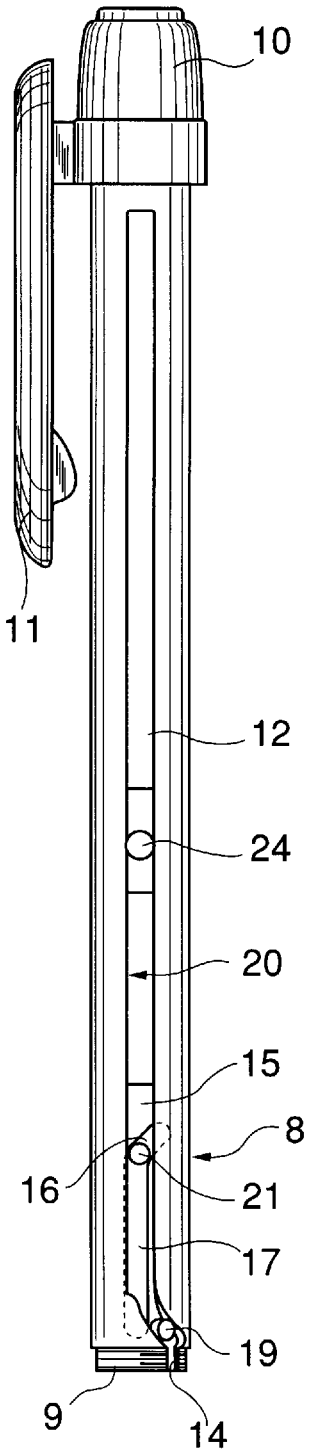
Figure 4C:
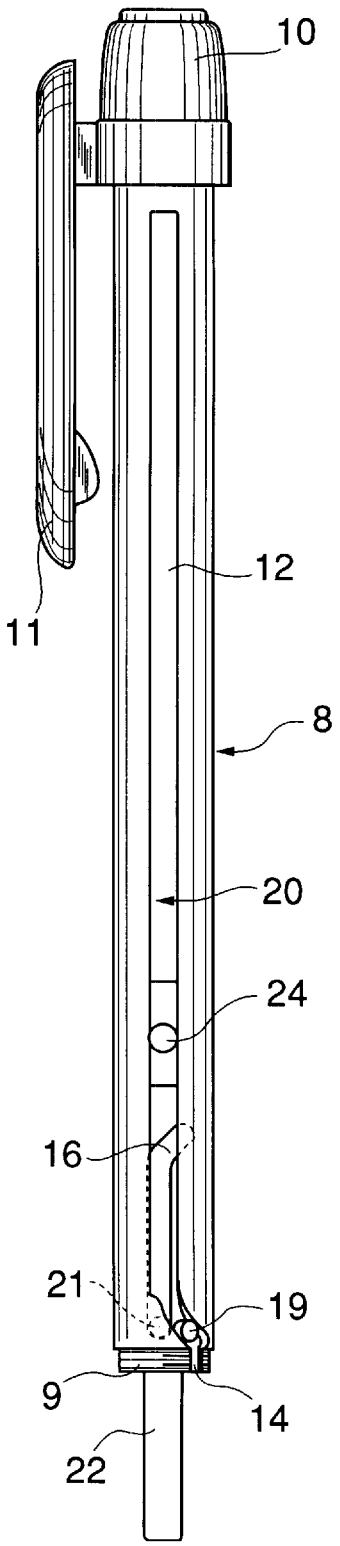
Figure 5:
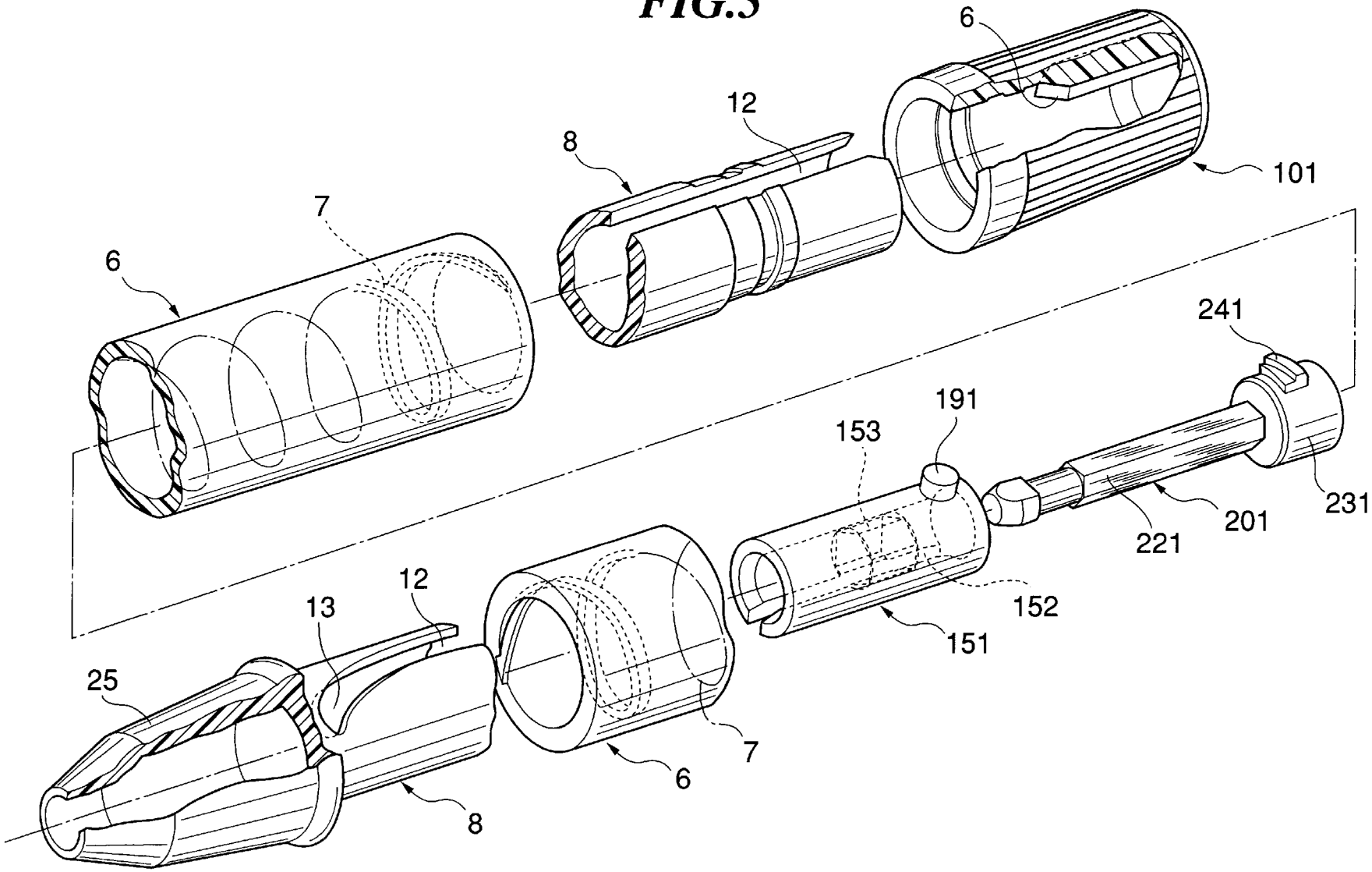
FIG. 5 is an exploded perspective view of a bar extruding implement in a second embodiment according to the present invention with certain portions omitted.
Figure 6:
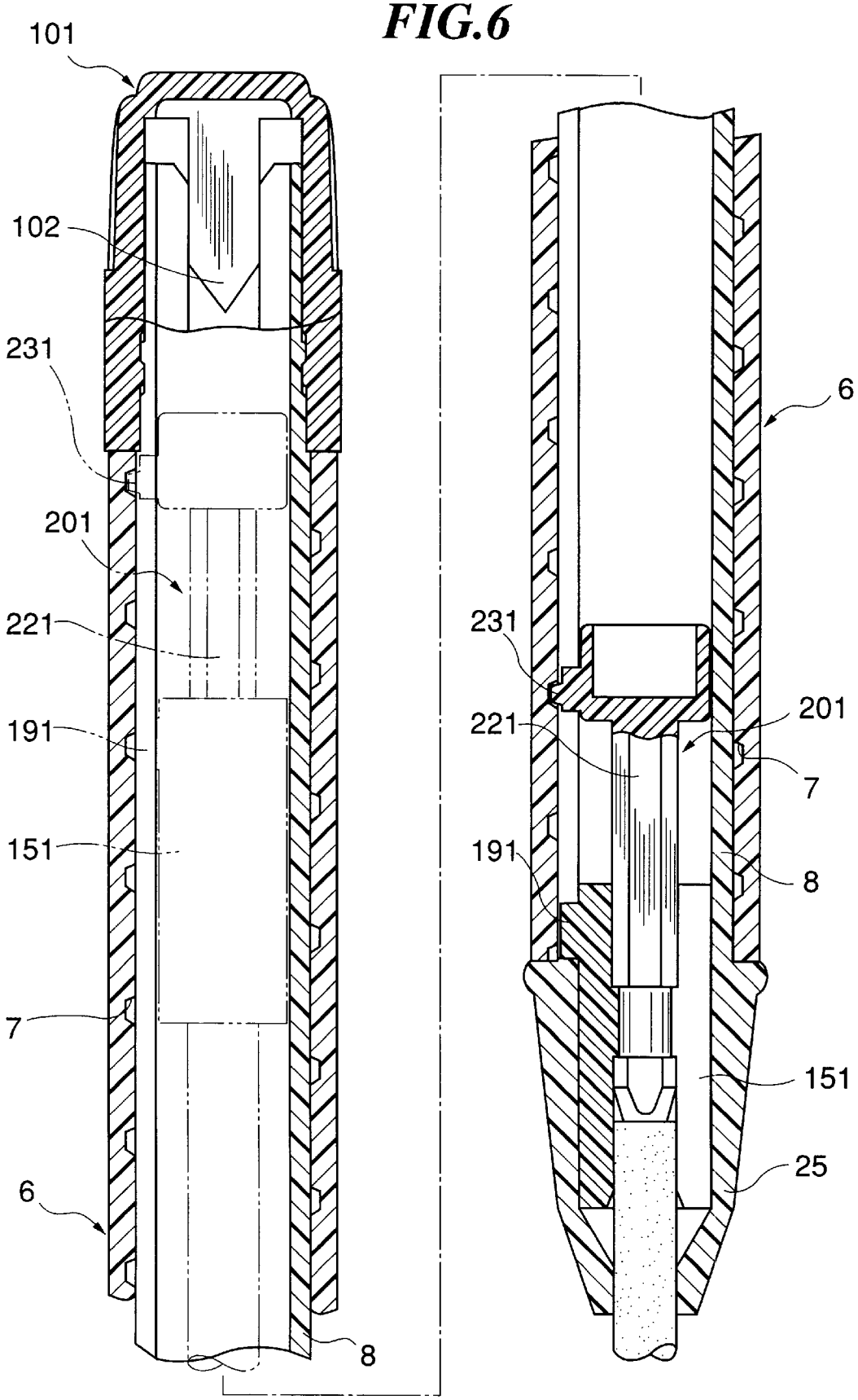
FIG. 6 is a longitudinal sectional view of the bar extruding implement of FIG. 5 with the middle portion omitted, a bar holder at its front limit position and a sliding rod at its rear limit position.
Figure 7:
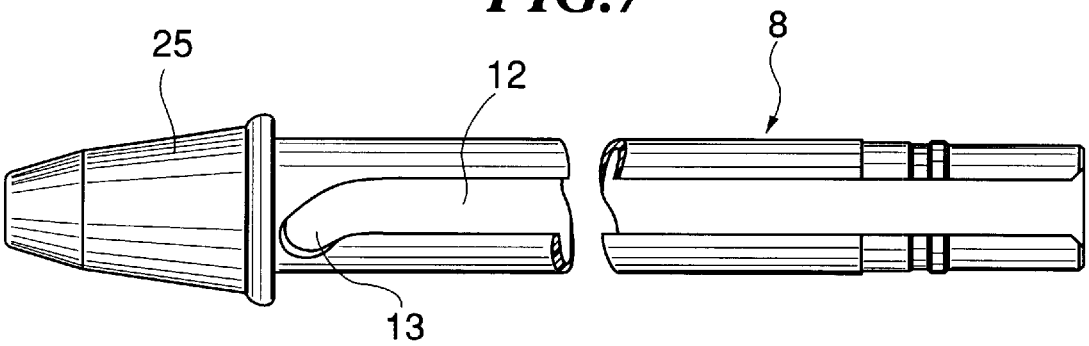
FIG. 7 is a front view of an inner tube included in the bar extruding implement of FIG. 5.

Referring to FIGS. 2 to 4 showing a bar extruding implement in a first embodiment according to the present invention, a barrel 6 having opposite open ends is provided with a helical groove 7 in its inner circumference, and an inner tube 8 provided with an external screw thread 9 on its front end is inserted through the rear end of the barrel 6 with its front end projecting from the front end of the barrel 6. The inner tube 8 is rotatable in the barrel 6. A rotational operating head 10 and a clip 11 are formed integrally with the rear end of the inner tube 8. The inner tube 8 is provided with a longitudinal guide slit 12 having a front portion curved to form a guide section 13, and a slit 14 in the externally threaded front end thereof. A hollow bar holder 15 for holding a bar, provided on its outer surface with a projection 19 is inserted in the inner tube 8 with the projection 19 in engagement with the longitudinal slit 12 of the inner tube 8. The bar holder 15 is provided with a longitudinal guide groove 17 having a rear curved section 16 having an open rear end 18. A sliding member 20 having a rod portion 22 and a sliding head 23 formed at the rear end of the rod portion 22, and provided with a first projection 21 on the rod portion 22 and a second projection 24 on the sliding head 23 is inserted in the bar holder 15 with the first projection 21 in engagement with the guide groove 17 of the bar holder 15 and with the second projection 24 in engagement with the helical groove 7 of the barrel 6.

When assembling the bar extruding implement, first, the open rear end 18 of the guide groove 17 of the bar holder 15 is expanded and the rod portion 22 of the sliding member 20 is inserted in the bar holder 15, and then the bar holder 15 and the sliding member 20 are pushed in the inner tube 8 expanding the slit 14 formed in the front end of the inner tube 8 so that the second projection 24 is able to slip into the slit 12 of the inner tube 8. Then, the assembly of the inner tube 8, the bar holder 15 and the sliding member 20 is inserted through the rear open end of the barrel 6 in the barrel 6, and the barrel cap 25 provided with the internal screw thread 26 is screwed on the front end of the inner tube 8 provided with the external screw thread 9 and projecting from the front end of the barrel 6.

When extruding a bar held by the bar holder 15, the rotational operating head 10 formed integrally with the rear end of the inner tube 8 and integrally provided with the clip 11 is turned in one direction. Then, the second projection 24 of the sliding member 20 slides along the helical groove 7 formed in the inner circumference of the barrel 6 and the bar holder 15 moves forward with the projection 19 thereof axially sliding along the slit 12 of inner tube 8 and with the curved section 16 of the guide groove 17 thereof in engagement with the first projection 21 of the sliding member 20, so that the bar held by the bar holder 15 is extruded gradually from the barrel 6. When the rotational operating head 10 is turned in the opposite direction, the foregoing operations of the components are reversed to retract the bar into the barrel 6.

Operation for ejecting a marginal portion of the bar will be described hereinafter. In FIG. 4A, the bar holder 15 and the sliding member 20 are at their rearmost positions, respectively, in which the second projection 24 of the sliding member 20 is at the rear end of the slit 12 of the inner tube 8, the first projection 21 of the sliding member 20 is in the curved section 16 of the guide groove 17 of the bar holder 15, and the sliding member 20 and the bar holder 15 are connected. When the rotational operating head 10 is turned further to advance the sliding member 20 and the bar holder 15 after the bar holder 15 has reached a releasing position shown in FIG. 4B, the first projection 21 of the sliding member 20 moves out of the curved section 16 of the guide groove 17 of the bar holder 15 and moves forward along the straight section of the guide groove 17. In this state, the projection 19 of the bar holder 15 moves from the straight section into the curved guide section 13 of the guide slit 12 of the inner tube 8, and the sliding member 20 starts moving forward relative to the bar holder 15. Eventually, the first projection 21 of the sliding member 20 reaches the front end of the guide groove 17 and the front portion of the rod portion 22 of the sliding member 20 projects from the front end of the bar holder 15 to eject the marginal portion of the bar from the bar holder 15.

Second Embodiment

Figure 8:
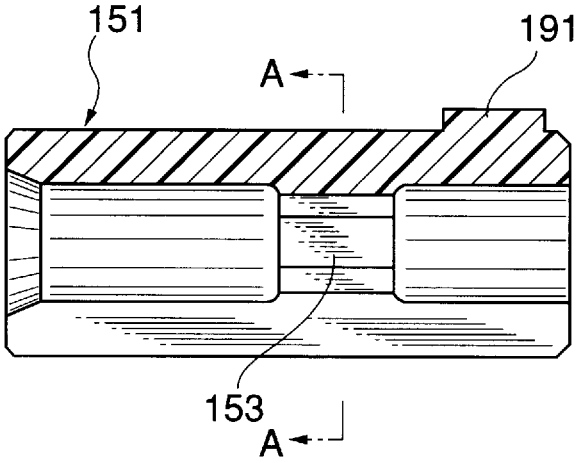
FIG. 8 is a longitudinal sectional view of a bar holder included in the bar extruding implement of FIG. 5.
Figure 9:
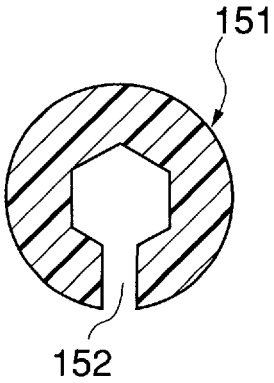
FIG. 9 is a sectional view taken on line A—A in FIG. 8.
Figure 10:
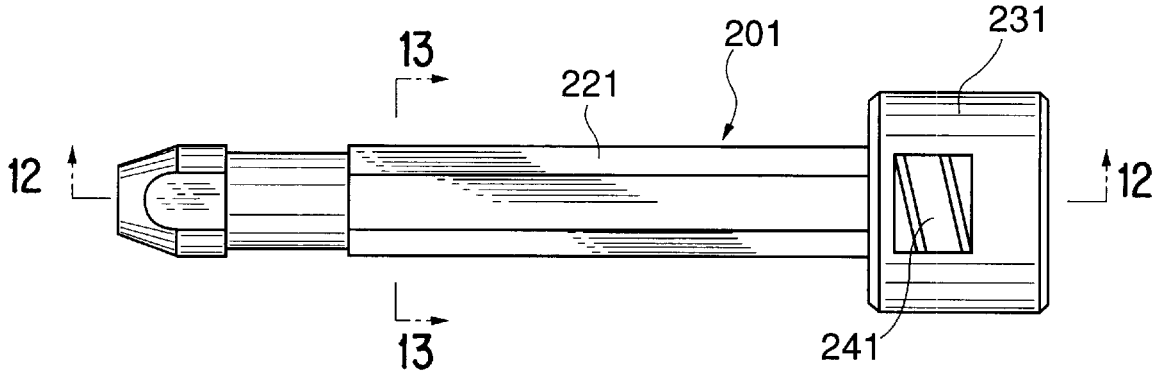
FIG. 10 is a front view of a sliding rod included in the bar extruding implement of FIG. 5.
Figure 11:
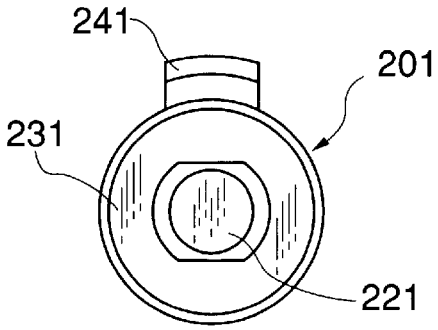
FIG. 11 is a left end view of the sliding rod of FIG. 10.
Figure 12:
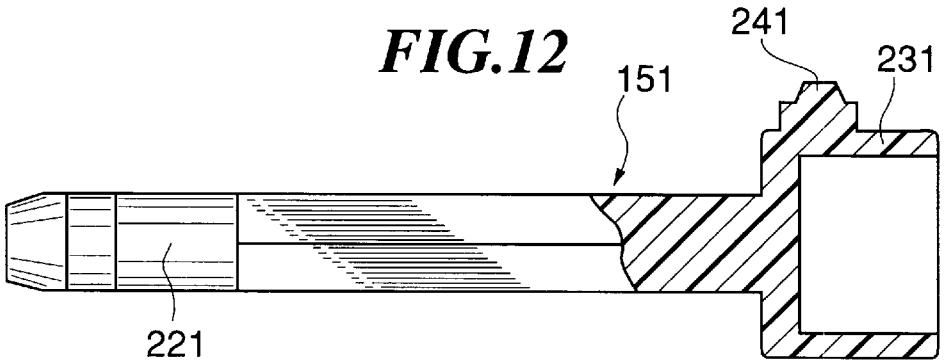
FIG. 12 is a sectional view taken on line B—B in FIG. 10.
Figure 13:
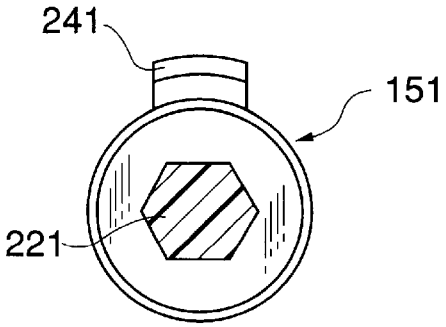
FIG. 13 is a sectional view taken on line C—C in FIG. 10.

Referring to FIGS. 5 to 14 showing a bar extruding implement in a second embodiment according to the present invention, an inner tube 8 is provided integrally with a barrel cap 25 and has an open rear end and a longitudinal guide slit 12 having a curved guide section 13 in its front end, and a rotational operating head 101 is fitted in the open rear end of the inner tube 8. A leg 102 formed integrally with the operating head 101 is fitted in the open rear end of the guide slit 12 for reinforcement. A hollow bar holder 151 provided with a projection 191 on its outer surface is slidably inserted in the inner tube 8 with the projection 191 in engagement with the guide slit 12. As best shown in FIG. 8 and 9, the bar holder 151 has a hexagonal hole 153 formed at a position spaced from the opposite ends thereof so that one of the corners thereof is aligned with the center of the projection 191. A sliding member 201 having a rod portion 221 and a sliding head 231 formed at the rear end of the rod portion 221 and provided with a projection 241 is inserted slidably in the bar holder 151 with the projection 241 in engagement with a helical groove 7 formed in the inner circumference of a barrel 6. The sliding member 201 is axially slidable. As shown in FIG. 10 and 13, the rod portion 221 has a hexagonal cross section. One of the six sides of the rod portion 221 is aligned with the projection 241 formed on the outer surface of the sliding member 201, i.e., the six sides of the rod portion 221 are dislocated by an angle of 30° from those of the hexagonal hole 153 of the bar holder 151.

When assembling the bar extruding implement, a longitudinal slit 152 formed in the bar holder 151 is expanded and the hexagonal rod portion 221 is the sliding member 201 is inserted in the rear bore of the bar holder 151. Since the bar holder 151 has the hexagonal hole 153 spaced from the opposite ends thereof and angularly dislocated from the hexagonal rod portion 221, the front end of the rod portion 221 is unable to be inserted in the hexagonal hole 153 and the insertion of the rod portion 221 in the bar holder 151 is limited by the wall defining the hexagonal hole 153. The assembly of the bar holder 151 and the sliding member 201 is inserted through the open rear end of the inner tube 8 in the inner latter, the inner tube 8 is inserted in the barrel 6, and then the rotational operating head 101 is fitted in the open rear end of the barrel 6 with the leg 102 thereof fitted in the guide slit 12 of the inner tube 8. Finally, a bar is inserted through the front end of the barrel cap 25 in the bar holder 151. Since the bar holder 151 is provided with the longitudinal slit 152 and the bar holder 151 has an inside diameter. slightly smaller than the diameter of the bar, the bar can be easily and firmly held by the bar holder 151 even if the diameters of bars vary in a certain range.

Figure 14A:
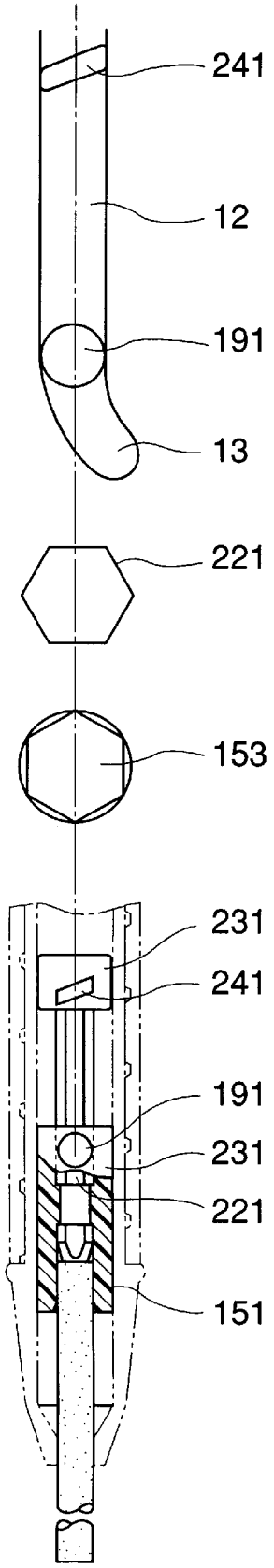
FIGS. 14A and 14B are fragmentary sectional view of assistance in explaining the bar extruding implement of FIG. 5.
Figure 14B:
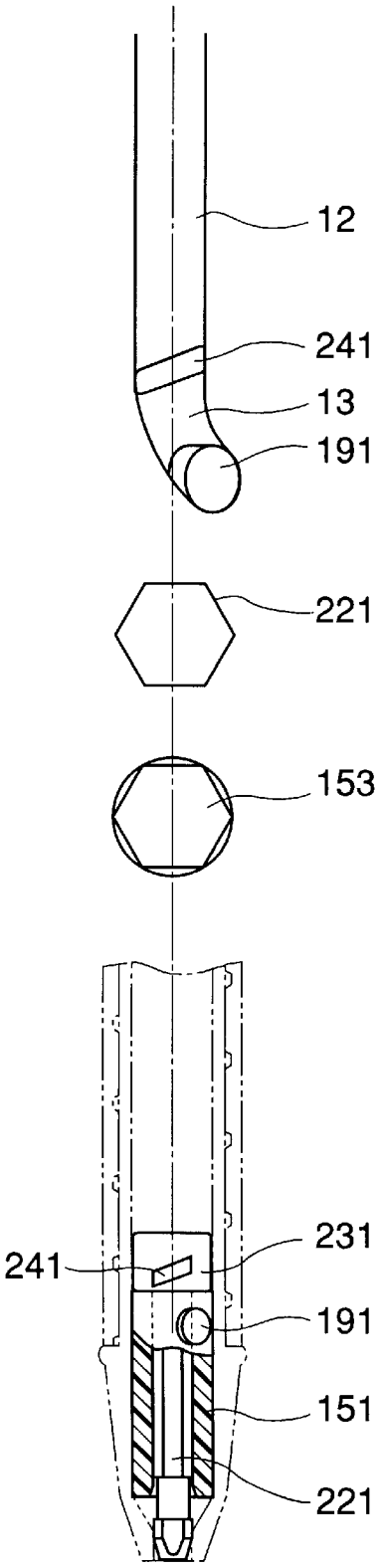

When the operating head 101 fitted in the rear end of the barrel 6 is turned to extrude the bar, the projection 241 of the sliding member 201 slides along the helical groove 7 formed in the inner circumference of the barrel 6, so that the sliding member 201 and the bar holder 151 holding the bar move forward and the projection 191 of the bar holder 151 slides along the guide slot 12 of the inner tube 8 as shown in FIG. 14A. Since the guide slit 12 has the curved guide section 13 in its front portion, the bar holder 151 turns after the projection 191 has entered the curved guide section 13 and, consequently, the hexagonal hole 153 of the bar holder 151 is aligned with the hexagonal rod portion 22 of the sliding member 201 as shown in FIG. 14B. Then, the rod portion 221 of the sliding member 201 is able to advance further through the hexagonal hole 153 to eject a marginal portion of the bar from the bar extruding implement.

Third Embodiment

Figure 15:
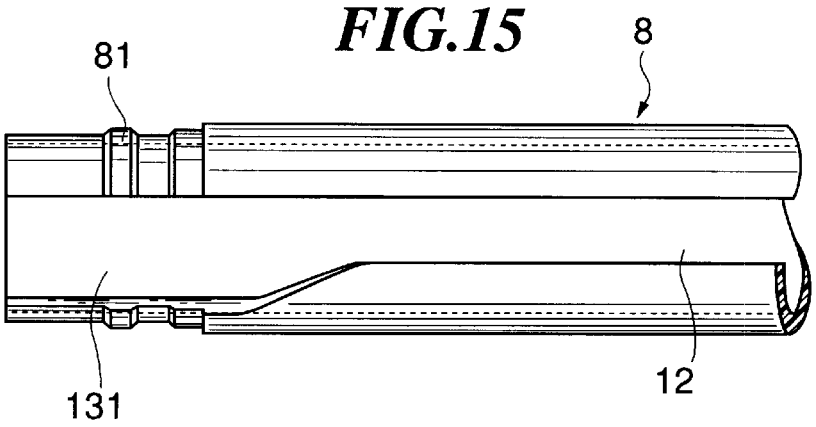
FIG. 15 is a fragmentary front view of the front portion of an inner tube included in a bar extruding implement in a third embodiment according to the present invention.
Figure 16:
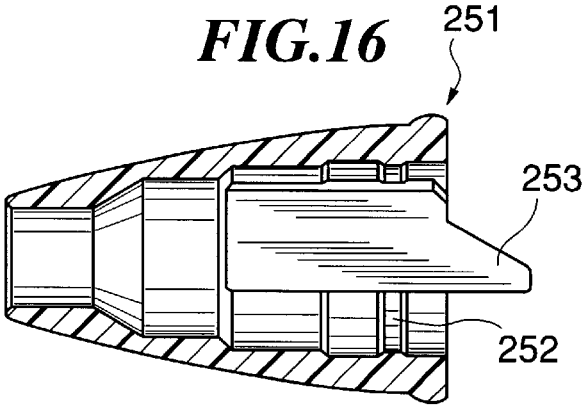
FIG. 16 is a sectional view of a barrel cap included in the bar extruding implement in the third embodiment.
Figures 17A, 17B:
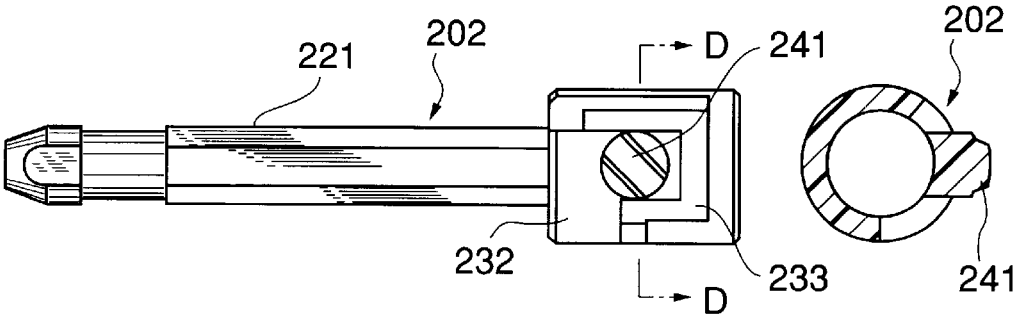
FIG. 17A is a front view of a sliding rod included in the bar extruding implement in the third embodiment.
FIG. 17B is a sectional view taken on line D—D in FIG. 17A.
Figures 18A, 18B:
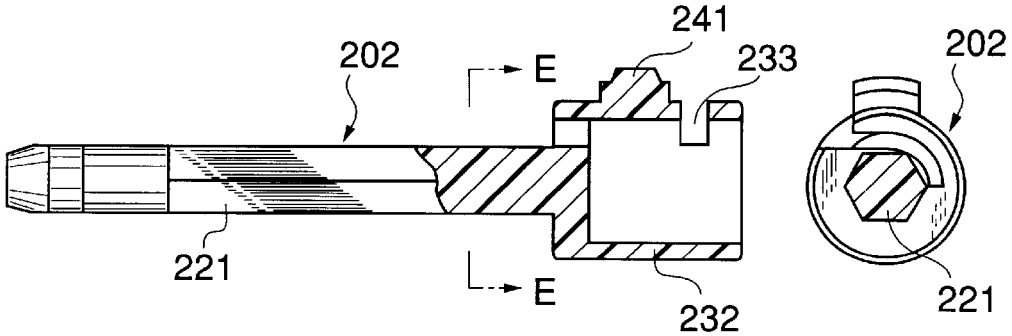
FIG. 18A is a partly sectional front view of the sliding rod of FIGS. 17A and 17B.
FIG. 18B is a sectional view taken on the line E—E in FIG. 18A
Figure 19:
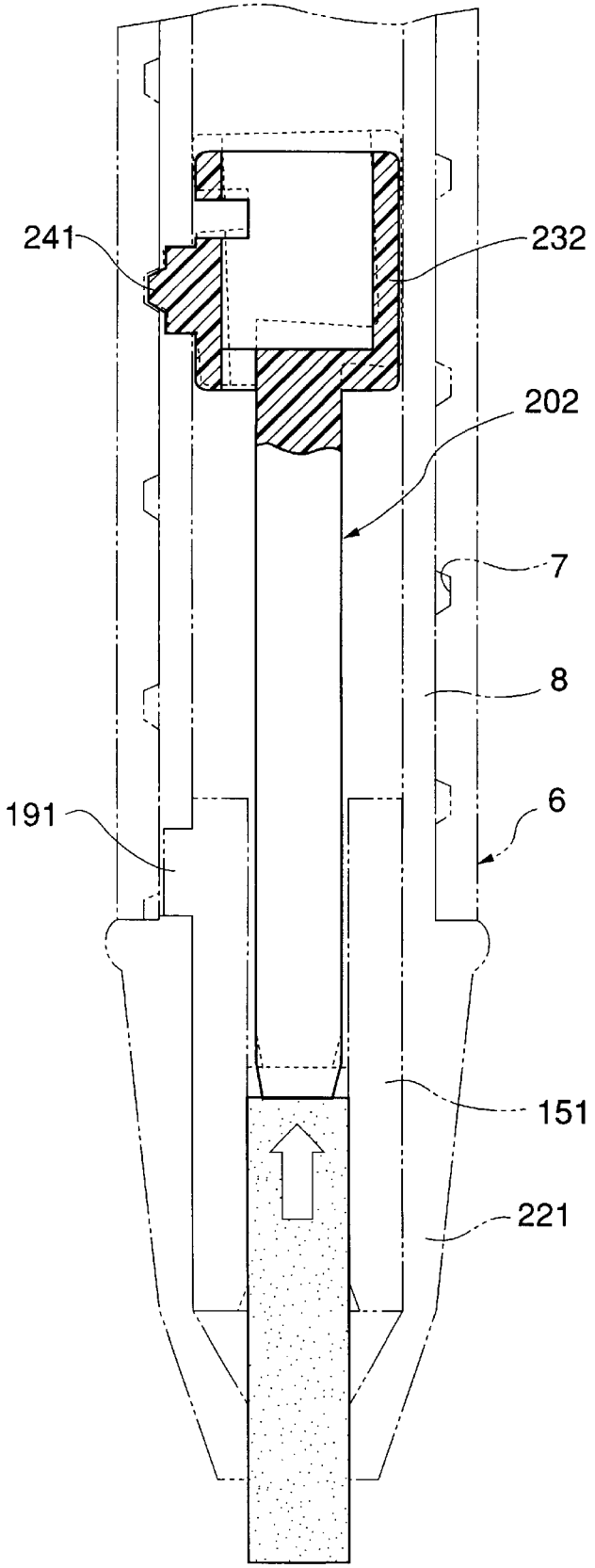
FIG. 19 is a fragmentary longitudinal sectional view of assistance in explaining the deformation of the sliding rod of FIGS. 17A and 17B when an excessive pressure is applied thereto.

Referring to FIGS. 15 to 19 showing a bar extruding implement in a third embodiment according to the present invention, an inner tube 8 is provided with a longitudinal guide slit 12 having a flared guide section 131 formed by curving one side of the front portion thereof as shown in FIG. 15. Referring to FIG. 16 showing a barrel cap 251 in a sectional view, the barrel cap 251 is provided with an annular groove 252 for receiving an annular protrusion 81 formed on the inner tube 8 in the rear portion of the inner circumference thereof, and a leg 253 to be fitted in the guide slit 12 of the inner tube 8 at the rear end thereof. When fitted in the guide slit 12 of the inner tube 8, the leg 253 reinforces the front end of the inner tube 8 and defines a curved guide section. Referring to FIGS. 17A, 17B, 18A and 18B, a sliding member 202 has a rod portion 221 and a sliding head 232 formed at the rear end of the rod portion 221. A groove 233 is formed in the sliding head 232 to form an elastically deformable portion which is deformed when an excessive pressure acts on a bar held by the bar extruding implement. Since the sliding member 202 has the elongate rod portion 221 and the sliding head 232, the sliding member 202 is deformed in a shaped indicated by dotted lines in FIG. 19 when an excessive pressure acts on the bar and the rear edge of the sliding head 232 is pressed against the inner surface of the inner tube 8, so that the sliding member 202 is restrained from rearward movement and hence the bar is not pushed into the barrel 8. The bar extruding operation of the bar extruding implement in the third embodiment is basically the same as that of the bar extruding implement in the second embodiment and hence the description thereof will be omitted.

In any one of the first, the second and the third embodiment, the inner tube 8 may be provided with a plurality of guide slits 12, for example, two diametrically opposite guide slits 12. Preferably, the opposite ends of the plurality of guide slits 12 are closed in view of securing a sufficient strength of the inner tube 8. If the inner tube 8 of the first embodiment is provided with a plurality of guide slits 12 having opposite closed ends and is not provided with the slit 14, the bar holder 15 and the sliding member 20 cannot be inserted through the front end of the inner tube 8. In such a case, the guide slit 12 is expanded forcibly and the bar holder 15 and the sliding member 20 can be inserted through the expanded guide slit 12 in the inner tube 8.

Fourth Embodiment

Figure 20:
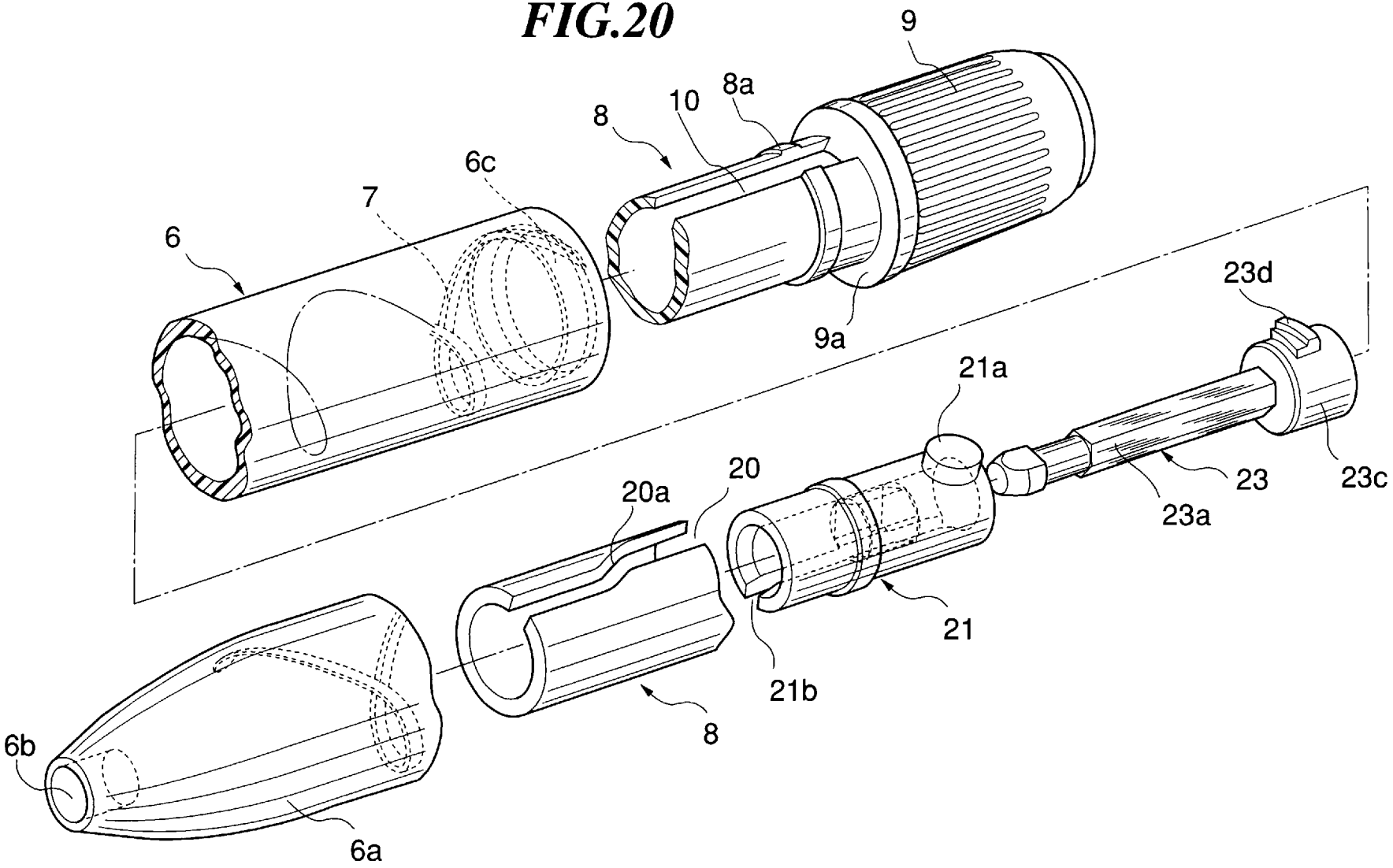
FIG. 20 is an exploded perspective view of a bar extruding implement in a fourth embodiment according to the present invention with certain parts omitted.
Figure 21:
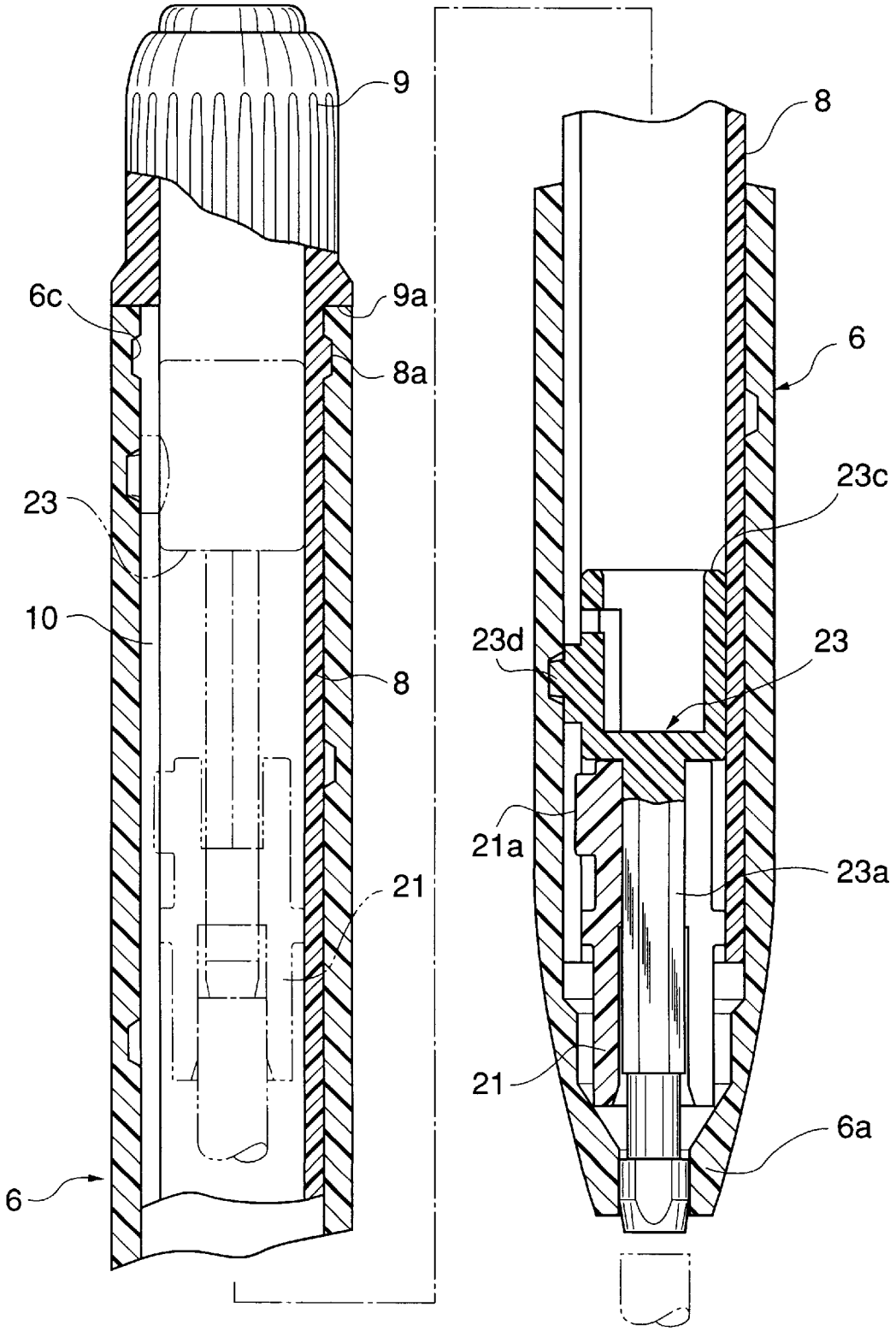
FIG. 21 is a longitudinal sectional view of the bar extruding implement of FIG. 20 with a bar holder and a sliding rod at their front limit positions, respectively.
Figure 22:
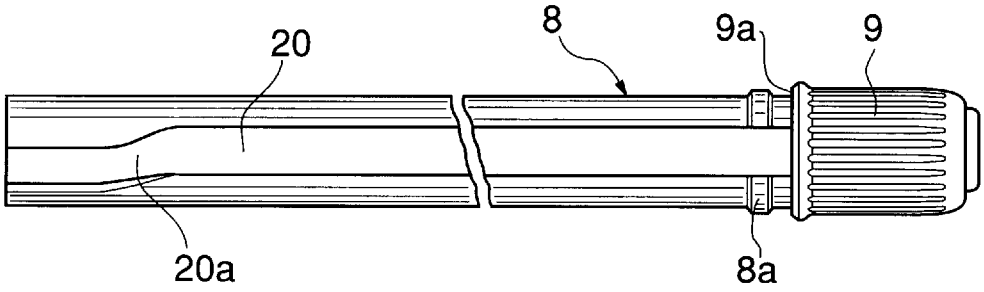
FIG. 22 is a front view of an inner tube included in the bar extruding implement of FIG. 20.
Figure 23:
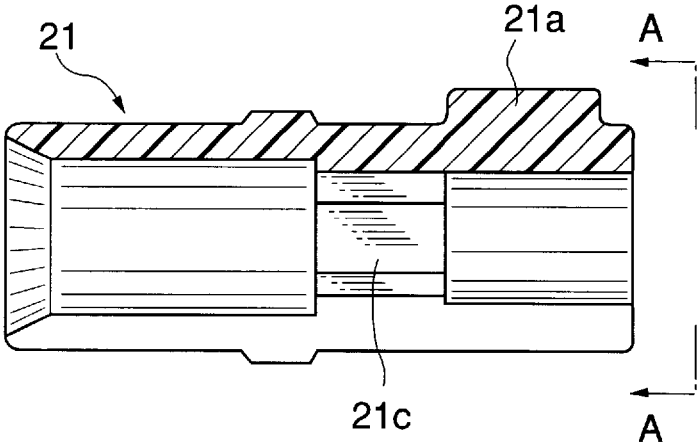
FIG. 23 is a longitudinal sectional view of a bar holder included in the bar extruding implement of FIG. 20.
Figure 24:
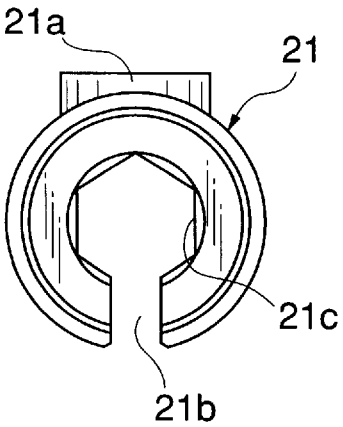
FIG. 24 is a sectional view of the bar holder of FIG. 23.
Figure 25:
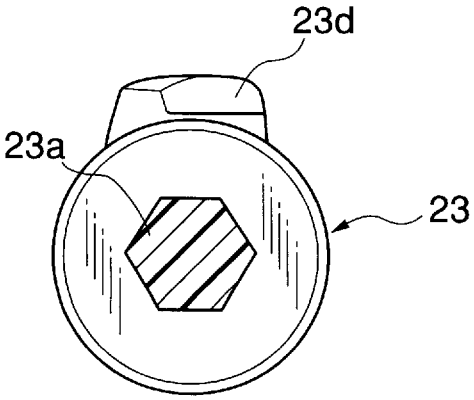
FIG. 25 is a partly sectional end view of a sliding member included in the bar extruding implement of FIG. 20.

Referring to FIGS. 20 to 22 showing a bar extruding implement in a fourth embodiment according to the present invention, a barrel 6 is provided with a helical guide groove 7 in its inner circumference and an annular groove 6*c* in its inner circumference near the rear end, and is provided integrally with a barrel cap 6*a*. An inner tube 8 is provided with a longitudinal guide slit 20 having a curved cam section 20*a* and an annular protrusion 8*a* near the rear end thereof. A rotational operating head 9 is formed integrally with the inner tube 8 at the rear end of the latter. A hollow bar holder 21 provided with a longitudinal slit 21*b* formed through the length thereof and a projection 21*a* as shown in FIG. 20 is inserted slidably in the inner tube 8 with the projection 21*a* in engagement with the guide slit 20 of the inner tube 8. As best shown in FIGS. 23 and 24, the bar holder 21 has a hexagonal hole 21*c* formed at a position spaced from the opposite ends thereof so that one of the corners thereof is aligned with the center of the projection 21*a*. A sliding member 23 having a rod portion 23*a* and a sliding head 23*c* formed at the rear end of the rod portion 23*a* and provided with a projection 23*d* is inserted slidably in the bar holder 21 with the projection 23*d* in engagement with a helical groove 7 formed in the inner circumference of a barrel 6. The sliding member 23 is axially slidable. As shown in FIG. 25, the rod portion 23*a* has a hexagonal cross section. One of the six sides of the rod portion 23*a* is aligned with the projection 23*d* formed on the outer surface of the sliding member 23, i.e., the six sides of the rod portion 23*a* are dislocated by an angle of 30° from those of the hexagonal hole 21*c* of the bar holder 21.

When assembling the bar extruding implement, the longitudinal slit 21*b* of the bar holder 21 is expanded, the hexagonal rod portion 23*a* is inserted in the rear bore of the bar holder 21. Since the bar holder 21 has a hexagonal hole 21*c* spaced from the opposite ends thereof and angularly dislocated from the hexagonal rod portion 23*a* of the sliding member 23, the front end of the rod portion 23*a* is unable to be inserted in the hexagonal hole 21*c* and the insertion of the rod portion 23*a* in the bar holder 21 is limited by the wall defining the hexagonal hole 21*c*. The assembly of the bar holder 21 and the sliding member 23 is inserted through the open rear end of the inner tube 8 the inner tube 8 is inserted in the barrel 6 so that the annular protrusion 8*a* is received in the annular groove 6*c* of the barrel 6. Finally, a bar is inserted through the front end of barrel 6 in the bar holder 21. Since the bar holder 151 is provided with the longitudinal slit 21*b* and the bar holder 21 has an inside diameter slightly smaller than the diameter of the bar, the bar can be easily and firmly held by the bar holder 21 even if the diameters of bars vary in a certain range.

Figure 26A:
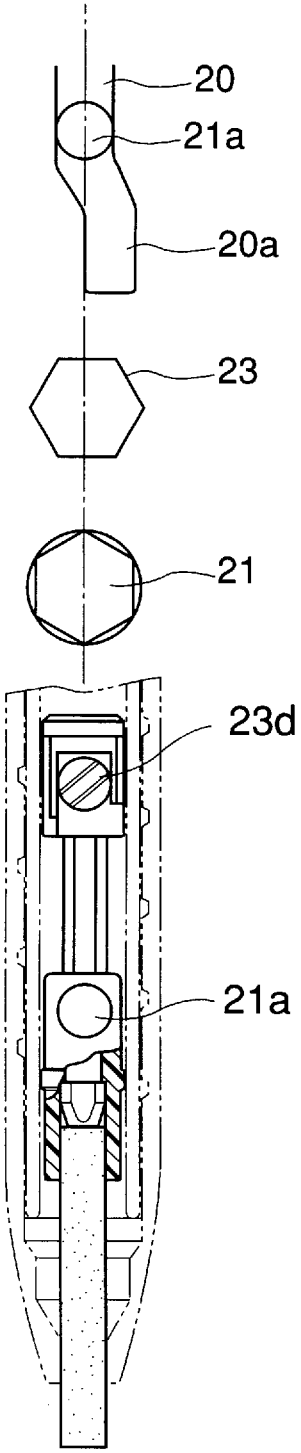
FIGS. 26A and 26B are fragmentary longitudinal sectional views of assistance in explaining the operation of the bar extruding implement of FIG. 20.
Figure 26B:
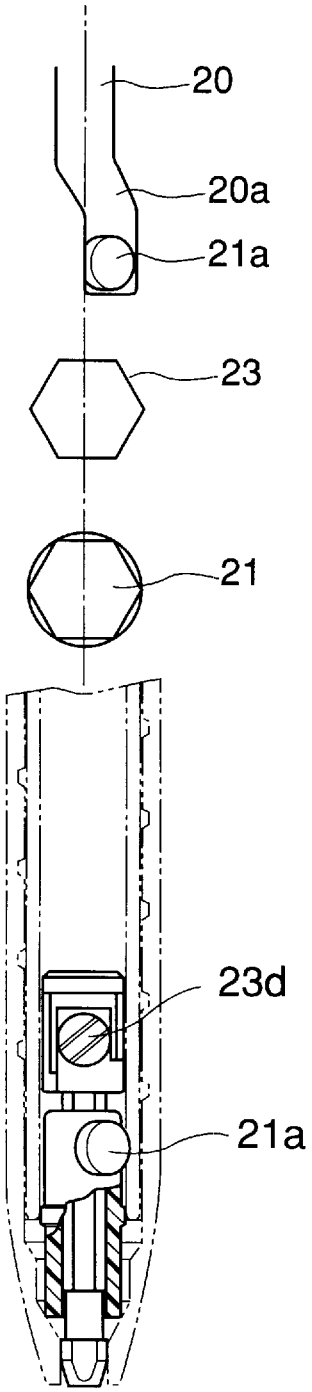

Referring to FIGS. 26A and 26B, when the rotational operating head 9 of the bar extruding implement is turned to extrude the bar held by the bar holder 21, the projection 23*d* of the sliding member 23 slides along the helical groove 7 formed in the inner circumference of the barrel 6, so that the sliding member 23 and the bar holder 21 holding the bar move forward and the projection 21*a* of the bar holder 21 slides along the guide slit 20 of the inner tube 8 as shown in FIG. 26A. Since the guide slit 20 has the curved cam section 20*a* in its front portion, the bar holder 21 turns after the projection 21*a* has entered the curved cam section 20*a* and, consequently, the hexagonal hole 21*c* of the bar holder 21 is aligned with the hexagonal rod portion 23*a* of the sliding member 23 as shown in FIG. 26 Be. Then, the rod portion 23*a* of the sliding member 23 is able to advance further through the hexagonal hole 21*c* to eject a marginal portion of the bar from the bar extruding implement.

Incidentally, when the pitch of the helical groove 7 formed in the inner circumference of the barrel 6 is comparatively large, the helix angle of the helical groove 7 is comparatively small. A helical groove having a comparatively large pitch is easy to form and able to extrude a comparatively large length of the bar when the rotational operating head is turned through a comparatively small angle. When forming the barrel 6 by drawing, such a helical groove having a comparatively large pitch can be formed by fixedly holding a core pin and turning the barrel 6, so that barrels can be produced at an increased number of shots. However, when the barrel 6 is provided with a helical groove having a comparatively large pitch, there is the possibility that the bar is pushed back into the barrel 6 when an excessively large pressure acts on the bar. On the other hand, when the barrel 6 is provided with a helical groove having a comparatively small pitch, the core pin must be turned when forming the barrel by drawing, which requires much time and increases the cost of the barrel 6.

Figure 27:
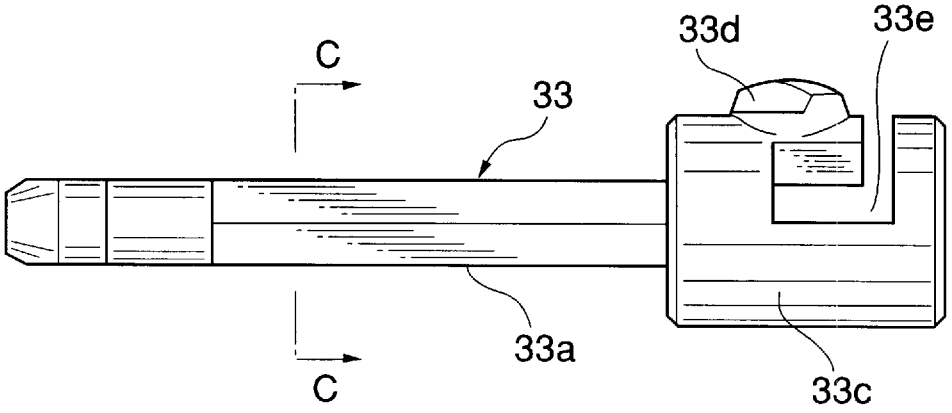
FIG. 27 is a front view of a sliding member included in a modification of the bar extruding implement of FIG. 20.
Figure 28:
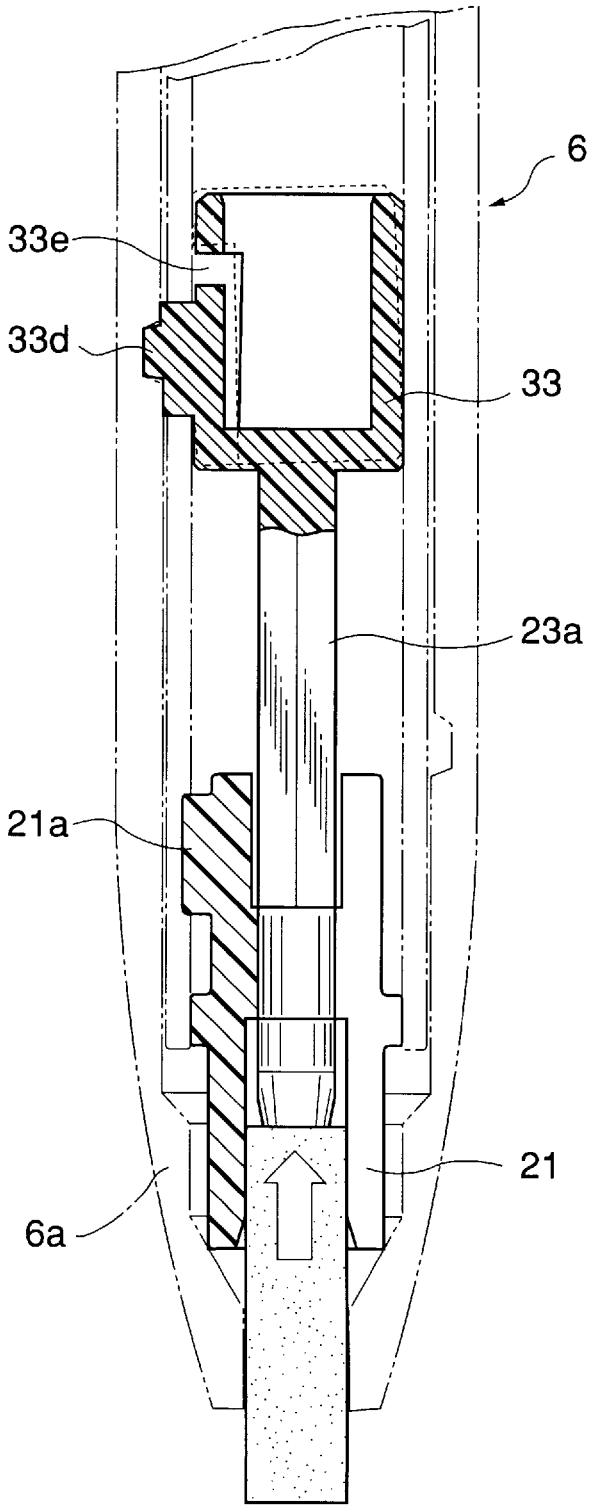
FIG. 28 is a fragmentary longitudinal sectional view of assistance in explaining the function of the sliding member of FIG. 27.

A bar extruding implement in a modification of the bar extruding implement in the fourth embodiment employs an improved sliding member 33 that prevents the bar from being easily pushed back into the barrel 6 even if the barrel 6 is provided with a helical groove having a comparatively large pitch. Referring to FIGS. 27 and 28 showing an improved sliding member 33, the sliding member 33 has a rod portion 33*a* and a sliding head 33*c* formed at the rear end of the rod portion 33*a* and provided with a recess 33*e*. The recess 33*e* allows the elastic deformation of the sliding head 33*c*. When an excessive pressure acts on the bar, the sliding head 33*c* is compressed and deformed as indicated by dotted lines in FIG. 28 in the inner tube 8. Consequently, the rear edge of the sliding head 33*c* is pressed against the inner surface of the inner tube 8, so that the sliding member 33 is restrained from rearward movement and hence the bar is not pushed into the barrel 8. The bar extruding operation of the bar extruding implement in a modification of the fourth embodiment is basically the same as that of the bar extruding implement in the fourth embodiment and hence the description thereof will be omitted.

Fifth Embodiment

Figure 29:
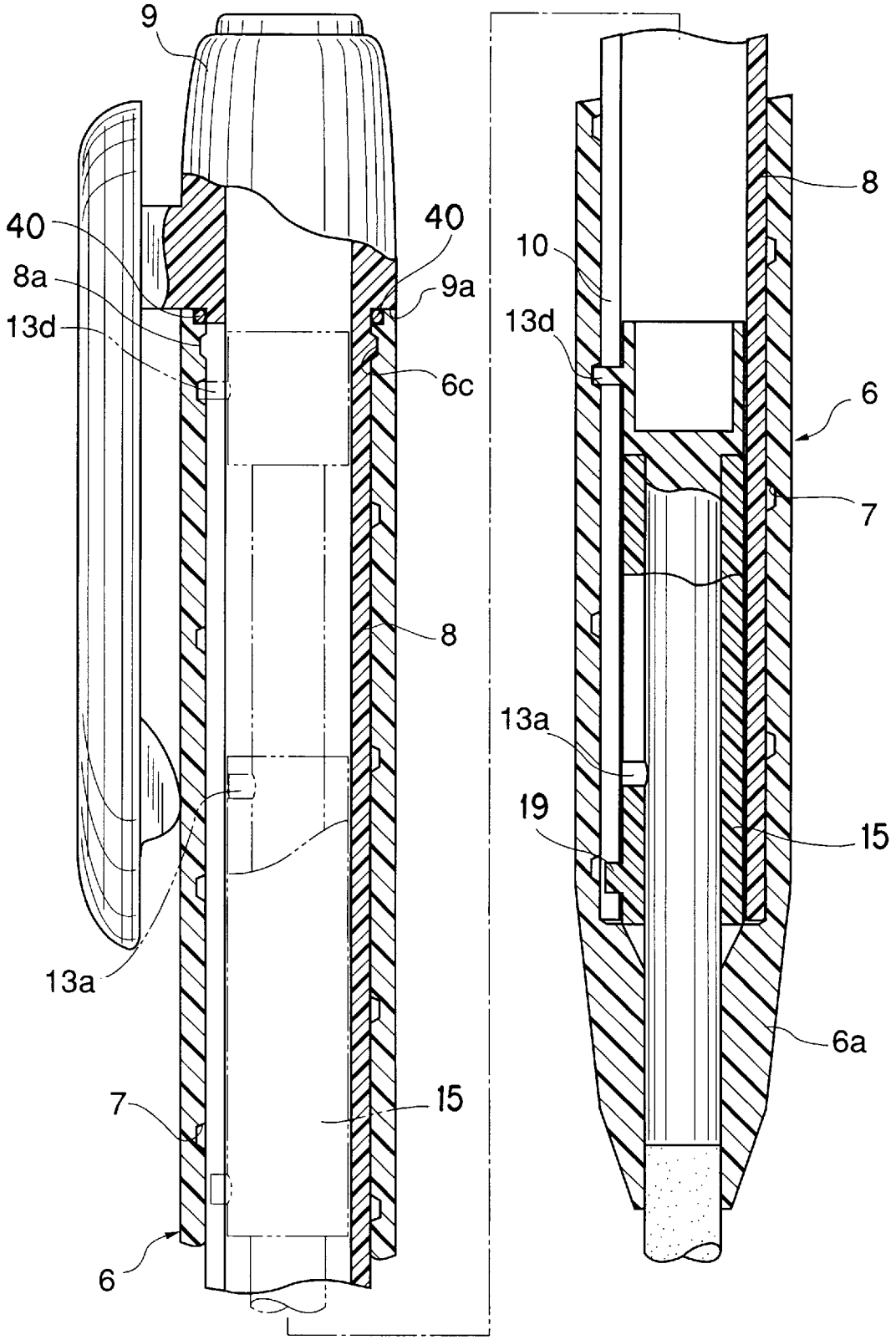
FIG. 29 is a longitudinal sectional view of a bar extruding implement in a fifth embodiment according to the present invention.

A bar extruding implement in a fifth embodiment according to the present invention shown in FIG. 29 is substantially the same in construction and functions as the bar extruding implement in the first embodiment, except that the bar extruding implement in the fifth embodiment is provided with a reverse rotation inhibiting means for inhibiting the reverse rotation of the inner tube 8, i.e., rotation in a direction to retract the bar held by the bar holder 21, to prevent the bar from being pushed back into the barrel 6.

Referring to FIG. 29, a circular recess is formed in the rear end of the inner tube 8, and a frictional circular member 40, such as a rubber O ring, is fitted in the circular recess of the inner tube 8 so that the frictional circular member 40 is compressed between the barrel 6 and the inner tube 8 to apply a frictional resistance to the rotation of the inner tube 8 relative to the barrel 6. The frictional resistance of the frictional circular member 40 gives a resistive, secure feeling to the touch when turning the rotational operating head 9 relative to the barrel 6, and the frictional circular member 40 absorbs variation in the dimensions of the associated parts.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A bar extruding implement comprising:

a barrel having opposite open ends and internally provided with a helical guide means formed in an inner surface of said barrel;

an inner tube rotatably inserted in the barrel and provided with a longitudinal guide slit having a curved guiding section in its front portion;

a barrel cap connected to the front end of the inner tube;

a rotational operating head connected to the rear end of the inner tube;

a hollow bar holder provided with a projection and inserted in the inner tube with the projection in engagement with the guide slit of the inner tube, said hollow bar holder further provided with a longitudinal guide groove;

a sliding member provided with a helical guide means following projection on its outer surface and inserted in the inner tube with the helical guide means following projection in engagement with the guide slit of the inner tube and the helical guide means of the barrel, said sliding member further provided with a guide groove projection in engagement with said longitudinal guide groove;

said longitudinal guide groove including an interlocking portion for interlocking the bar holder and the sliding member, and a disengaging portion for disengaging the bar holder and the sliding member.

2. A bar extruding implement according to claim 1, wherein the rotational operating head is formed integrally with the inner tube at the rear end of the inner tube, the bar holder is provided with a longitudinal guide slit having a curved rear section, the sliding member is provided with a guide slit following projection that is guided by the guide slit of the bar holder.

3. A bar extruding implement according to claim 2, wherein the front end of the guiding section of the guide slit of the inner tube is open.

4. A bar extruding implement according to claim 2, wherein the sliding member has a rod portion and a sliding head formed at the rear end of the rod portion, and the guide slit following projection is formed on the rod portion.

5. A bar extruding implement according to claim 1, further comprising a locking means formed between the barrel and the inner tube to allow the inner tube to turn relative to the barrel and to restrain the inner tube from axial movement relative to the barrel.

6. A bar extruding implement according to claim 5, wherein the locking means comprises an annular groove formed in the inner circumference of the barrel, and an annular groove formed on the outer circumference of the inner tube so as to be fitted in the annular groove of the barrel when the inner tube is inserted in the barrel and set in place.

7. A bar extruding implement according to claim 1, further comprising a locking means formed between the barrel and the inner tube to allow the inner tube to turn relative to the barrel and to restrain the inner tube from axial movement relative to the barrel, and a reverse turn inhibiting means for inhibiting the turning of the inner tube in a direction to retract a bar held by the bar holder.

8. A bar extruding implement according to claim 7, wherein the locking means comprises an annular groove formed in the inner circumference of the barrel, and an annular groove formed on the outer circumference of the inner tube so as to be fitted in the annular groove of the barrel when the inner tube is inserted in the barrel and set in place; and the reverse turn inhibiting means is a frictional O ring disposed between the barrel and the inner tube so as to be compressed between the barrel and the inner tube.

* * * * *